United States Patent [19]

Martin et al.

[11] 4,240,402

[45] Dec. 23, 1980

[54] GRATE FOR INDUSTRIAL FURNACES

[75] Inventors: Johannes J. Martin; Walter J. Martin, both of Munich, Fed. Rep. of Germany

[73] Assignee: Josef Martin Feuerungsbau GmbH., Munich, Fed. Rep. of Germany

[21] Appl. No.: 10,239

[22] Filed: Feb. 8, 1979

[30] Foreign Application Priority Data

Feb. 10, 1978 [DE] Fed. Rep. of Germany ..... 2805712

[51] Int. Cl.[3] ..... F23H 13/00

[52] U.S. Cl. ..... 126/152 B; 126/167; 110/268

[58] Field of Search ..... 126/152 R, 152 A, 152 B, 126/167, 174; 110/268, 269

[56] References Cited

U.S. PATENT DOCUMENTS

| | | | |
|---|---|---|---|
| 1,175,823 | 3/1916 | Rowley | 126/167 |
| 2,114,147 | 4/1938 | Kohout et al. | 126/167 |
| 2,955,812 | 10/1960 | Boron | 126/152 R |
| 3,038,712 | 6/1962 | Nagel et al. | 126/152 R |
| 4,018,168 | 4/1977 | Andreoli et al. | 110/268 |

FOREIGN PATENT DOCUMENTS

| | | | |
|---|---|---|---|
| 911317 | 5/1954 | Fed. Rep. of Germany | 126/152 R |

*Primary Examiner*—George T. Hall

*Attorney, Agent, or Firm*—Peter K. Kontler

[57] ABSTRACT

A grate for use in industrial furnaces has a frame which supports a number of elongated parallel grate bars having a T-shaped or U-shaped cross-sectional outline. One end portion of each bar has a socket which overlies a portion of an elongated rail forming part of or secured to the frame. The other end portions or the regions close to the other end portions of the bars are coupled to each other by a transverse shaft which holds the bars against movement at right angles to their longitudinal extensions and away from the frame. A second coupling system is provided close to the end portion of each bar to hold the bars against movement in the aforementioned direction. The second coupling system may include lateral projections provided on the bars and extending below or into openings of the neighboring bars. Alternatively, the second coupling system may include locking bolts which are affixed to or movable transversely of alternate bars and extend below or into openings of one or both neighboring bars. A single locking bolt can extend through openings in the lower portions of all bars. Alternate bars and eventually the coupling shaft and/or corresponding portions of the second coupling system are preferably reciprocable lengthwise of the remaining bars to allow for convenient expulsion of particles of foreign matter which happen to penetrate into the clearances between neighboring bars.

10 Claims, 11 Drawing Figures

GRATE FOR INDUSTRIAL FURNACES

BACKGROUND OF THE INVENTION

The present invention relates to improvements in grates for furnaces, especially for large industrial furnaces, and more particularly to improvements in means for mounting grate bars in or on the frame of a grate, particularly a grate which is movable by mechanical means in a furnace or the like. Still more particularly, the invention relates to improvements in grates of the type wherein one end portion of each grate bar engages with a portion of the frame and another portion of each grate is coupled with the neighboring grate or grates in such a way that the other portion cannot be shifted at right angles to the general plane of the assembled grate bars. The other portion of each grate bar may constitute the other end portion or an intermediate portion of the respective grate.

The bars of a grate must be separated from each other by clearances or gaps in order to allow for heat-induced expansion as well as to permit oxygen-containing gases to contact, from below, the layer of burning fuel on the grate. Fragments of burning fuel invariably penetrate into the aforementioned clearances and tend to increase the distance between neighboring grate bars. Shifting of one or more grate bars from their normal positions can entail jamming of an entire series or row of bars and/or lifting of one or more bars to a level above the remaining components of the respective section of the grate.

Attempts to prevent lifting of grate bars include the provision of one or more lateral protuberances which extend from the grate bars and into openings of the neighboring grate bars or are disposed below suitably configurated ribs of neighboring bars. Such protuberances connect the grate bars to each other against upward movement (i.e., at right angles to the general plane of the grate) and/or against movements of discrete grate bars in the direction of movement of the entire grate. Sidewise shifting of neighboring grate bars with respect to each other is prevented or impeded by the provision of lateral blocking plates. In accordance with a further known proposal which is disclosed in German Pat. No. 911,317, neighboring grate bars are connected to each other by hook-shaped coupling elements which hold such bars against upward movement as well as against sidewise movement relative to each other. The hook-shaped coupling elements can extend into elongated openings of neighboring grate bars so as to enable the bars to move lengthwise to the extent which is determined by the length of openings. Such movements are desirable or necessary in order to allow for convenient cleaning of the grate, i.e., for expulsion of fragments of fuel and/or solid combustion products from the aforementioned clearances. In such instances, alternate grate bars are fixedly mounted in the frame of the grate and the remaining bars are movable lengthwise of the fixedly mounted bars.

*The German Patent No. 911,317 fully discloses the means for moving every second row of grate bars.

When solid particles of foreign matter penetrate between and prevent relative movement of certain grate bars or of each and every bar, the ends of mobile bars are likely to be lifted off the frame because such ends merely rest on the adjacent portions of the frame. Since the coupling elements for neighboring bars are disposed in the front or median portions of the bars (as mentioned above, such elements normally prevent upward movements and, in some instances, also lengthwise movements of neighboring bars relative to each other), the foreign particles are likely to produce a shear effect, i.e., at least one of two neighboring grate bars pivots with respect to the other bar not unlike one half of a shears. The pivot axis for such movement is defined by the coupling elements. This causes those end portions of grate bars which are remote from the points of connection to the frame to rise above and away from the grate bars therebelow. As a grate bar pivots relative to the neighboring bar, the width of the clearance therebetween increases whereby the clearance is even more likely to receive one or more large particles of solid foreign matter to prevent pivotal movement of the displaced bar back to its original position. This prevents or interferes with orderly operation of the corresponding stage of the grate, i.e., the stage or section is likely to jam and/or to undergo minor or major physical damage including total destruction.

OBJECTS AND SUMMARY OF THE INVENTION

An object of the invention is to provide a novel and improved grate wherein all bars are held against undesirable movements with respect to each other and/or with respect to the frame.

Another object of the invention is to provide novel and improved grate bars which can be utilized in the above outlined grate.

A further object of the invention is to provide novel and improved coupling means between neighboring grate bars.

An additional object of the invention is to provide a grate wherein the particles of foreign matter which penetrate between the bars cannot pivot the bars and/or enlarge the clearances between neighboring grate bars.

The invention is embodied in a grate, particularly in a mechanically movable grate for use in industrial furnaces, especially large industrial furnaces. The grate comprises a support (e.g., a suitable metallic frame), a plurality of substantially parallel elongated grate bars (each such grate bar can have a substantially T-shaped or substantially U-shaped cross-sectional outline) provided on the support and each having an end portion engaging the support (to this end, the support may include an elongated rail which is adjacent to the end portions of the bars and each bar may have a socket in the underside of its end portion to receive the adjacent part of the rail), first coupling means (e.g., a shaft which extends transversely of the bars) for connecting second portions of the grate bars to each other against movement in a direction substantially at right angles to the longitudinal extensions of the bars and away from the support (such second portions of the grate bars are remote from the aforementioned end portions and may constitute or may be located close to the other end portions of the respective bars), and second coupling means for connecting the neighboring grate bars to each other against movement in the aforementioned direction. The second coupling means is disposed between the rail of the support and the first coupling means, preferably close to the rail. Such second coupling means may comprise projections provided on and extending laterally of the bars so as to be overlapped by or to extend into openings provided therefor in the neighboring bars. Alternatively, the second coupling means may comprise transversely extending locking bolts which are connected to alternate bars and are overlapped by one or both neighboring bars. If desired, the projections may constitute substantially hook-shaped elements which extend into openings of the neighboring bars to prevent movement of bars in the aforementioned direction as well as laterally of and away from each other.

In accordance with a presently preferred embodiment, the bars include alternating first and second bars and the second bars are movable, together with or relative to the coupling means, with respect to the first bars in the longitudinal direction of the bars to allow for convenient cleaning of the grate.

The novel features which are considered as characteristic of the invention are set forth in particular in the appended claims. The improved grate itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
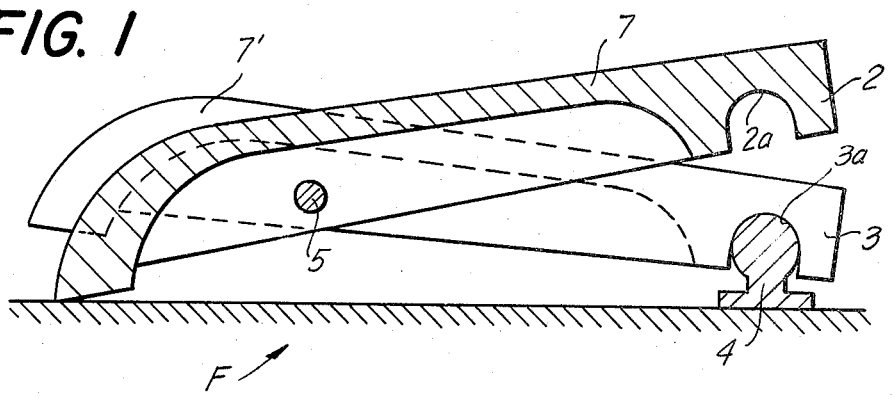
PRIOR ART FIG. 1
FIG. 1 is a longitudinal sectional view of a first bar and an elevational view of a second bar in a conventional grate.

FIG. 1 shows two grate bars 1 and 1' of a conventional grate which further includes a frame or support F having a rail 4 whose head normally extends into the sockets 2*a*, 3*a* provided in the undersides of the right-hand end portions 2 and 3 of the respective bars 1 and 1'. The coupling which connects the bars 1, 1' (and the non-illustrated additional bars) of the grate comprises a shaft 5 which extends through registering holes of the bars and is remote from the end portions 2 and 3. The shaft 5 allows only pivotal movements of the bars with respect to each other, i.e., the bars are held against movement in a direction to rise to a level above the neighboring bars. In other words, an entire grate bar cannot move upwardly with respect to the general plane of the grate and/or in the longitudinal direction thereof. However, and as shown in FIG. 1, the grate bars 1 and 1' can pivot with respect to each other not unike the halves of shears. Such situation will arise when a bar is pivoted in a counterclockwise direction so as to lift its end portion 2 or 3 above and away from the rail 4.

The aforementioned pivotal movements of grate bars are avoided, in accordance with the invention, in a manner as illustrated in FIGS. 2 to 11.

Figure 2:
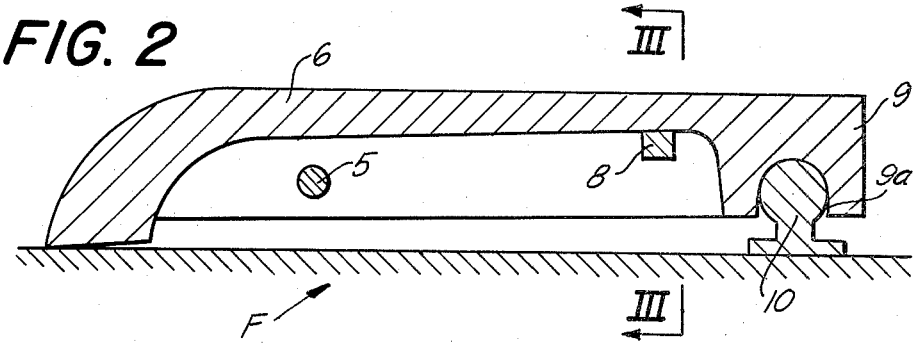
FIG. 2 is a fragmentary sectional view of a grate whose bars are constructed and assembled in accordance with a first embodiment of the invention.
Figure 3:
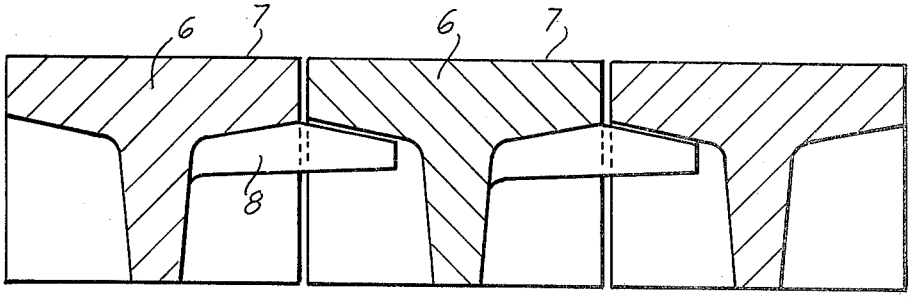
FIG. 3 is an enlarged transverse vertical sectional view as seen in the direction of arrows from the line III—III of FIG. 2.

Referring first to FIGS. 2 and 3, there are shown three neighboring bars 6 of a grate. Each bar 6 has a substantially T-shaped cross-sectional outline and includes a substantially flat upper section or spine 7. The underside of each section 7 is provided with a laterally extending projection or finger 8 which is overlapped by the section 7 of the neighboring bar 6. Consequently, the bars 6 cannot pivot about the coupling shaft 5 and the sockets 9*a* of their end portions 9 receive the head of the rail 10. The shaft 5 holds the bars 6 against lengthwise movement relative to each other, and the fingers 8 hold the bars against pivotal movement. The fingers 8 are adjacent to the end portions 9. If the shaft 5 extends into elongated slots of alternate bars 6, such alternate bars can move lengthwise with respect to the neighboring bars. Alternatively, the bars 6 having circular openings for the coupling shaft 5 and the shaft 5 can move relative to the bars 6 which are provided with elongated slots for the shaft 5. The sockets of the bars 6 having the aforementioned slots are then elongated so that such bars can reciprocate lengthwise with respect to the frame F and its rail 10.

The fingers constitute a second coupling means which connects the neighboring bars 6 to each other against movement in a direction at right angles to the longitudinal extensions of the bars and away from the frame F. Such second coupling means is disposed between the first coupling means (shaft 5) and the end portions 9. Those (second) portions of bars 6 which are connected to each other by the shaft 5 may but need not constitute the left-hand end portions of the bars, as viewed in FIG. 2.

Figure 4:
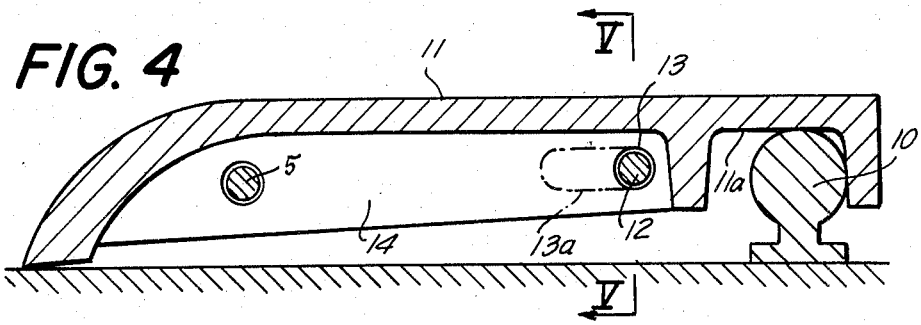
FIG. 4 is a fragmentary sectional view of a grate whose bars are constructed and assembled in accordance with a second embodiment of the invention.
Figure 5:
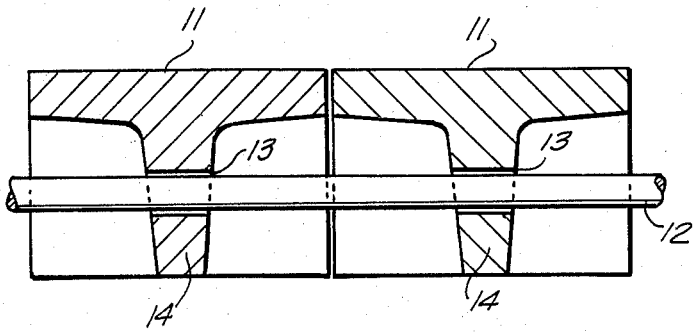
FIG. 5 is an enlarged transverse vertical sectional view as seen in the direction of arrows from the line V—V of FIG. 4.

In the embodiment of FIGS. 4 and 5, the grate bars 11 of the entire grate are coupled to each other by a transversely extending locking bolt 12 which extends through circular openings 13 in the downwardly extending ribs or webs 14 of the bars 11. If the grate is to be designed in such a way that alternate bars 11 are movable lengthwise of the neighboring bars, such alternate bars 11 are formed with openings in the form of elongated slots 13*a* (one shown by phantom lines). The head of the rail 10 then extends into elongated sockets 11*a* in the respective end portions of the aforementioned alternate bars.

The locking bolt 12 constitutes a second locking means (in addition to the first locking means, not shown) which prevents pivotal movements of neighboring bars 11 relative to each other and replaces the fingers 8 of FIGS. 2 and 3.

Figure 6:
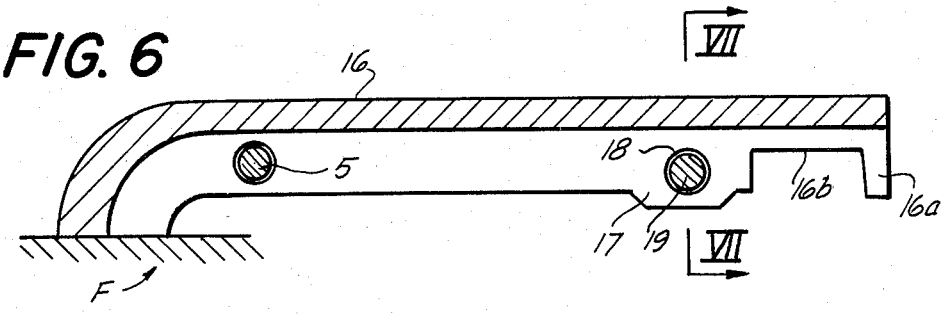
FIG. 6 is a fragmentary sectional view of a grate whose bars are constructed and assembled in accordance with a third embodiment of the invention.
Figure 7:
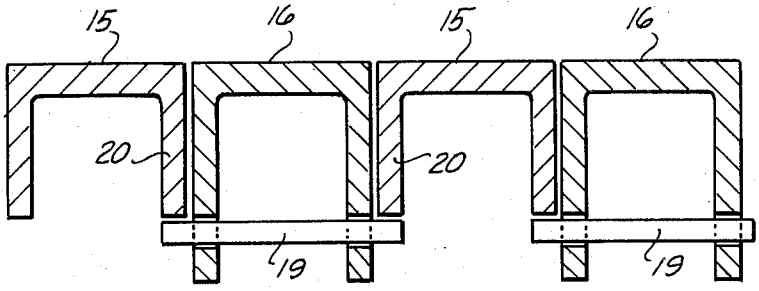
FIG. 7 is an enlarged transverse vertical sectional view as seen in the direction of arrows from the line VII—VII of FIG. 6.

FIGS. 6 and 7 show a portion of a grate which comprises alternate bars 15 and 16 of different design. Each grate bar has an inverted U-shaped cross-sectional outline. Those end portions (16*a*) of the bars 16 which are adjacent to the rail (not shown) have downwardly extending lugs 17 with openings 18 for transversely extending locking bolts 19 projecting laterally below the adjacent flanges 20 of the neighboring bars 15. The flanges 20 are devoid of lugs 17. The bars 15 are affixed to the rail and the end portions 16*a* of the bars 16 have elongated sockets 16*b* for the rail so that they can move lengthwise with respect to the rails 15. However, the bolts 19 prevent lifting of the bars 16 above the bars 15.

The bolts 19 constitute a second coupling means which is disposed between the first coupling means (shaft 5) and those end portions of the bars which engage the rail on the frame or support F.

Figure 8:
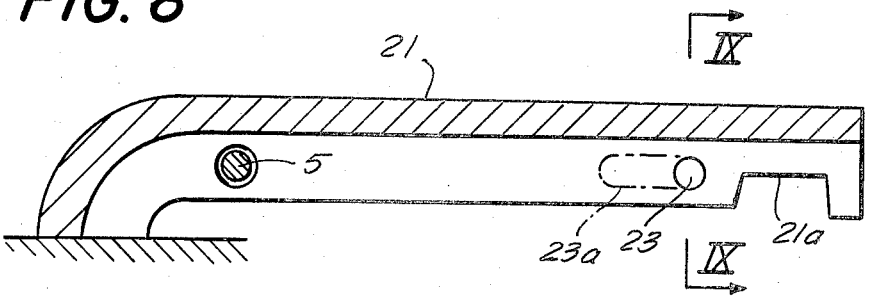
FIG. 8 is a fragmentary sectional view of a grate whose bars are constructed and assembled in accordance with a fourth embodiment of the invention.
Figure 9:
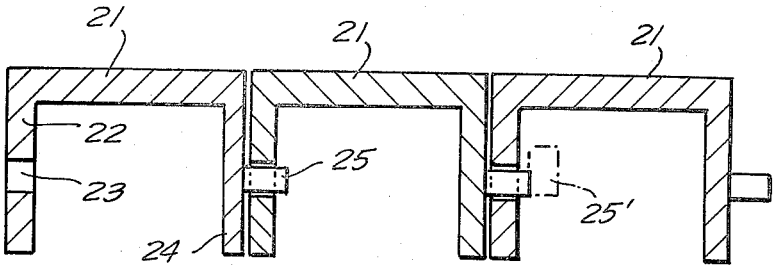
FIG. 9 is an enlarged transverse sectional view as seen in the direction of arrows from the line IX—IX of FIG. 8.

In the embodiment of FIGS. 8 and 9, the grate is assembled of similar or identical inverted U-shaped bars 21. One flange 24 of each bar 21 has a laterally extending projection or post 25 which is received in a complementary opening 23 in the other flange 22 of the neighboring bar 21. If desired or necessary, each second bar 21 can be fixedly secured to the rail (not shown) and the other bars 21 have elongated sockets 21*a* and elongated openings or slots 23*a* (one shown by phantom lines) which enable the other bars 21 to move lengthwise of the fixedly mounted (neighboring) bars.

FIG. 9 further shows a hook-shaped projection 25' (indicated by phantom lines) which can replace some or all of the posts 25 to hold the neighboring bars 21 against sidewise movement with respect to each other.

The posts 25 and/or the hook-shaped projections 25' constitute the second coupling means which is disposed between the first couping means (shaft 5) and the right-hand end portions 21*b* of the bars 21, as viewed in FIG. 8. The second coupling means prevents pivotal movements of bars 21 about the axis of the shaft 5.

Figure 10:
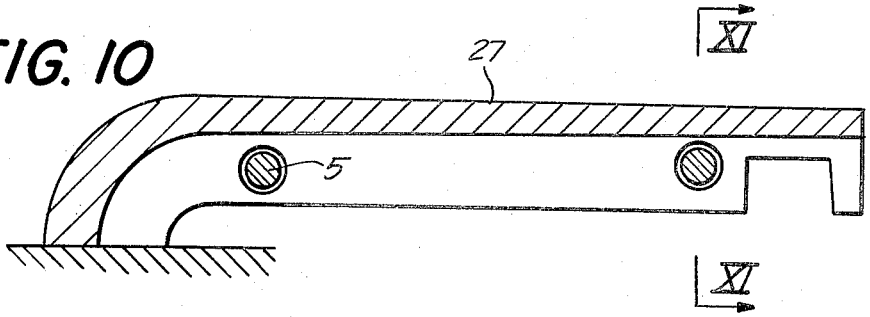
FIG. 10 is a fragmentary sectional view of a grate whose bars are constructed and assembled in accordance with a fifth embodiment of the invention.
Figure 11:
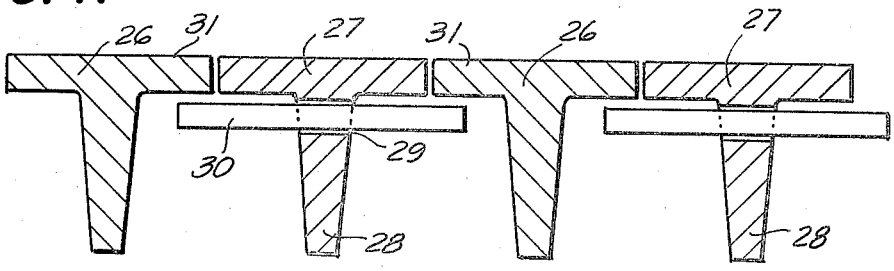
FIG. 11 is an enlarged transverse sectional view as seen in the direction of arrows from the line XI—XI of FIG. 10.

FIGS. 10 and 11 show the bars 26 and 27 of a further grate. All of the bars have a T-shaped cross-sectional outline. The bars 26 are fixedly secured to the rail (not shown) and the bars 27 are movable lengthwise of the bars 26. The webs or ribs 28 of reciprocable bars 27 have openings 29 for locking bolts 30 each extending transversely of the respective bar 27 and below the spines 31 of both neighboring (fixedly mounted) bars 26. This insures that the bars 27 cannot be lifted above and away from the bars 26.

In each of the embodiments which are shown in FIGS. 2 to 11, those end portions of the bars which are remote from the respective rail are coupled to each other by a transverse shaft 5. The manner of inserting the shafts 5 is the same as described in connection with FIG. 1. It goes without saying that the shafts 5 do not prevent reciprocatory movements of selected bars, such as the bars 27 of FIGS. 10 and 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a grate, particularly in a mechanically movable grate for use in industrial furnaces, the combination of a support; a plurality of substantially parallel elongated grate bars provided on said support and each having an end portion engaging said support, said bars further having second portions remote from the respective end portions; first coupling means for connecting said second portions of neighboring grate bars to each other against movement in a direction substantially at right angles to the longitudinal extensions of said neighboring grate bars and away from said support; and second coupling means for connecting the neighboring grate bars to each other against movement in said direction, said second coupling means being disposed intermediate said end portions and said second portions of said bars.

2. The combination of claim 1, wherein said bars include alternating first and second bars and said second bars are movable relative to said first bars in the longitudinal direction of said bars.

3. The combination of claim 1, wherein said second coupling means comprises a projection extending laterally from each of said bars and overlapped by the neighboring bar.

4. The combination of claim 3, wherein said bars include portions disposed at a level above said projections of the neighboring bars.

5. The combination of claim 1, wherein said second coupling means comprises a projection extending laterally from each of said bars and into an opening provided therefor in a neighboring bar.

6. The combination of claim 1, wherein said bars include alternating first and second bars and each of said second bars has a transversely extending opening, said second coupling means comprising bolts received in said openings and extending laterally beyond the respective second bars, each of said bolts being overlapped by at least one first bar which is adjacent to the respective second bar.

7. The combination of claim 1, wherein said second coupling means comprises substantially hook-shaped lateral projections on said bars, said projections extending through openings provided therefor in the neighboring bars to hold such neighboring bars against movement in said direction and also in a direction to move the neighboring bars apart.

8. The combination of claim 1, wherein said bars have a T-shaped cross-sectional outline.

9. The combination of claim 1, wherein said bars have a substantially U-shaped cross-sectional outline.

10. The combination of claim 1, wherein said support includes an elongated rail and said first end portions of said bars have sockets for portions of said rail.

* * * * *